US005899083A

United States Patent [19]

Peterson et al.

[11] Patent Number: 5,899,083

[45] Date of Patent: May 4, 1999

[54] MULTI-COMPARTMENT REFRIGERATION SYSTEM

[75] Inventors: James R. Peterson; Steven J. Kuehl; Michael S. Kauffman, all of Stevensville; Jim J. Pastryk, New Troy; Devinder Singh, St. Joseph; Richard C. Spears, Stevensville; Jeffrey L. Burk, St. Joseph; Donald E. Janke, Benton Harbor, all of Mich.; Li Gong Ling, Singapore, Singapore

[73] Assignee: Whirlpool Corporation, Benton Harbor, Mich.

[21] Appl. No.: 09/044,475

[22] Filed: Mar. 19, 1998

Related U.S. Application Data

[62] Division of application No. 08/815,261, Mar. 12, 1997, Pat. No. 5,758,512.

[51] Int. Cl.[6] ..... F25D 17/08

[52] U.S. Cl. ..... 62/186; 62/408; 62/187

[58] Field of Search ..... 62/186, 187, 407, 62/408, 180

[56] References Cited

U.S. PATENT DOCUMENTS 5,209,073 5/1993 Thomas et al. ..... 62/186

5,377,498 1/1995 Cur et al. ..... 62/187

*Primary Examiner*—William Doerrler

*Attorney, Agent, or Firm*—Robert O. Rice; Andrea Powers Denklau; Stephen D. Krefman

[57] ABSTRACT

A refrigerator having a middle fresh food compartment and a relatively large bottom freezer compartment arranged below the fresh food compartment and a relatively small freezer compartment arranged above the fresh food compartment. The bottom freezer compartment preferably supports a drawer including a frame and a removable bin. Cool air can be supplied to the compartments of the refrigerator by employing a two fan control system such that no electromechanical baffles are required. Alternatively, cool air can be directed to the compartments of the refrigerator by use of a baffle which requires only a single electromechanical device to control air flow into three different compartments. The baffle includes a main rotary damper which can be positioned to provide proportional amounts of chilled air to the three separate compartments based on the degree of cooling required.

13 Claims, 12 Drawing Sheets

MULTI-COMPARTMENT REFRIGERATION SYSTEM

This is a division of application Ser. No. 08/815,261, filed Mar. 12, 1997 now U.S. Pat. No. 5,758,512.

BACKGROUND OF THE INVENTION

1. Field of Invention

The present invention relates to refrigeration appliances and more particularly to a refrigeration system for cooling multiple compartments.

2. Description of Related Art

In typical domestic refrigeration appliances, the appliance frequently has two separate compartments that are maintained at different temperatures. For example, there may be a freezer compartment which has a temperature maintained below 0° C. and a fresh food compartment which is maintained at a temperature somewhat above 0° C. In most commercially available refrigerators, the two different temperature compartments are cooled by single evaporator located in the freezer compartment.

In many instances, however, it may be desirable to provide a refrigeration appliance having three or more compartments in a stacked arrangement. This is often accomplished by providing two main compartments, one below 0° C. and one above 0° C., and partitioning one of the compartments into additional compartments—with minimal temperature variations between the partitioned compartments. In this manner, while three or more compartments are provided, often with separate access doors, only two substantive temperature zones actually exist.

An example of this type of refrigerator is shown in U.S. Pat. No. 4,788,832, which discloses a refrigerator having an upper freezer compartment and a lower refrigerator compartment. The lower refrigerator compartment is divided into two compartments—a middle fresh food type compartment and a bottom drawer-type fresh food compartment. While small temperature differences may exist between the middle and bottom compartment, since these compartments are not separated by insulation these temperature differences are minimal. This type of configuration provides three access doors but only two substantive temperature zones exist within the refrigerator.

Another example is U.S. Pat. No. 5,056,332, which discloses a refrigerator having an upper freezer compartment and a lower refrigeration compartment. The lower refrigeration compartment is further partitioned into an ice temperature compartment and a vegetable compartment. Separate baffles control cold air flow through independent passages to the lower refrigeration compartment and the ice temperature compartment such that the compartments may be maintained at respective predetermined temperatures in a temperature range of −1° C. to −3° C. The upper freezer and lower refrigeration compartments each have hinged doors and the ice temperature compartment and vegetable compartment are configured as slidable drawers.

U.S. Pat. No. 3,075,366 discloses a refrigerator having a main upper food storage compartment and a lower freezer compartment. The upper food storage compartment includes a horizontal partition for separating a drawer-type compartment from the main upper food compartment.

Other refrigerators provide three or more compartments wherein each compartment is thermally insulated from the other compartments and substantive differences in the temperature between compartments may exist. U.S. Pat. No. 5,377,498 discloses a refrigerator having three compartments—a top freezer compartment at approximately −18° C., a middle freezing compartment at approximately 0° C., and a bottom fresh food compartment at approximately 5° C. A plurality of dampers control air flow through a plurality of conduits such that each compartment can be independently supplied with cold air from an evaporator. The evaporator is disposed in either the bottom fresh food compartment or the upper freezer compartment and may be potentially operated at a plurality of different pressures.

SUMMARY OF THE PRESENT INVENTION

It can be seen therefore, that while the prior art teaches refrigerators having three or more access doors for accessing different compartments, the prior art does not teach the specific improvement of providing a refrigerator having three separate, stacked compartments wherein a relatively large freezer compartment is arranged below a fresh-food compartment and a relatively small freezer compartment is arranged above the fresh food compartment.

Moreover, it would be an improvement in the art to provide a refrigerator having three separate, stacked compartments wherein a relatively large freezer compartment configured as a slidable drawer is arranged below a fresh-food compartment and a relatively small freezer compartment is arranged above the fresh food compartment.

Further, it would be an improvement in the prior art if such a refrigerator—having three separate, stacked compartments—allowed for the bottom compartment to be selectively operated as either a freezer or a fresh food compartment.

It can also be seen that prior art multi-compartment refrigerators have employed a plurality of relatively costly and inefficient automatically controllable electromechanical dampers for selectively directing cold air into the compartments. It would be an improvement in the prior art, therefore, to provide a multi-compartment refrigerator having an air flow control system for selectively directing cold air into the compartments which did not require the use of electromechanical dampers. It would also be an improvement to provide an air control system for a refrigerator having three separately cooled compartments which required a single electromechanical damper.

Accordingly, the present invention is directed to a refrigerator having a first compartment maintained at a temperature below 0° C., a second compartment disposed below the first compartment and maintained above 0° C., and a third compartment, larger than the first compartment, disposed below the second compartment and maintained at a temperature below 0° C. An evaporator is disposed within an evaporator compartment within the second compartment. The third compartment can be a slidable drawer having a removable basket. The basket is configured to allow optimal air flow through the third compartment.

The present invention further includes an air control system including a duct connecting the evaporator compartment to the first and third compartment. A first fan is disposed in the duct, adjacent to the first compartment, and can be operated at a first speed for moving air into the first compartment and at a second speed, lower than the first speed, for preventing air flow out of the first compartment. A second fan is disposed in the duct, adjacent to the third compartment, and can be operated at a first speed for moving air into the third compartment and at a second speed, lower than the first speed, for preventing air flow out of the third compartment. A manual baffle serves to supply chilled air from the first compartment to the second compartment.

In a second embodiment, a refrigerator is provided having stacked top, middle and bottom compartments. An evaporator is disposed in the middle compartment within an evaporator chamber and a unique baffle assembly, driven by a single electromechanical device, is provided for selectively directing air flow to either the top, middle or bottom compartments. The baffle assembly includes a main rotary damper and a slide damper which is controlled by the cam action of tracks disposed about the periphery of the main damper.

In a third embodiment, a refrigerator is provided having stacked top, middle and bottom compartments. An evaporator is disposed in the middle compartment within an evaporator chamber and a unique, rotary damper, baffle assembly, driven by a single electromechanical device, is provided for selectively directing air flow to either the top or bottom compartments or proportionately between the top and bottom compartments. A manual baffle serves to supply air from the upper compartment to the middle compartment per present art. The air moving device is housed entirely within the main supply duct connecting the upper and lower compartments, thus reducing intrusion into the middle compartment useable volume.

In a fourth embodiment, a refrigerator is provided having stacked top, middle and bottom compartments. An evaporator is disposed in the middle compartment within an evaporator chamber and a unique, vertically translating damper, baffle assembly, driven by a single electromechanical device, is provided for selectively directing air flow to either the top or bottom compartments or proportionately between the top and bottom compartments. A manual baffle serves to supply air from the upper compartment to the middle compartment per present art. The air moving device axis is vertically orientated and partially housed within the structure wall thermally separating the upper and middle compartments, thus reducing intrusion into the middle compartment useable volume.

DETAILED DESCRIPTION OF THE PREFERRED EMBODIMENTS

Figure 1:
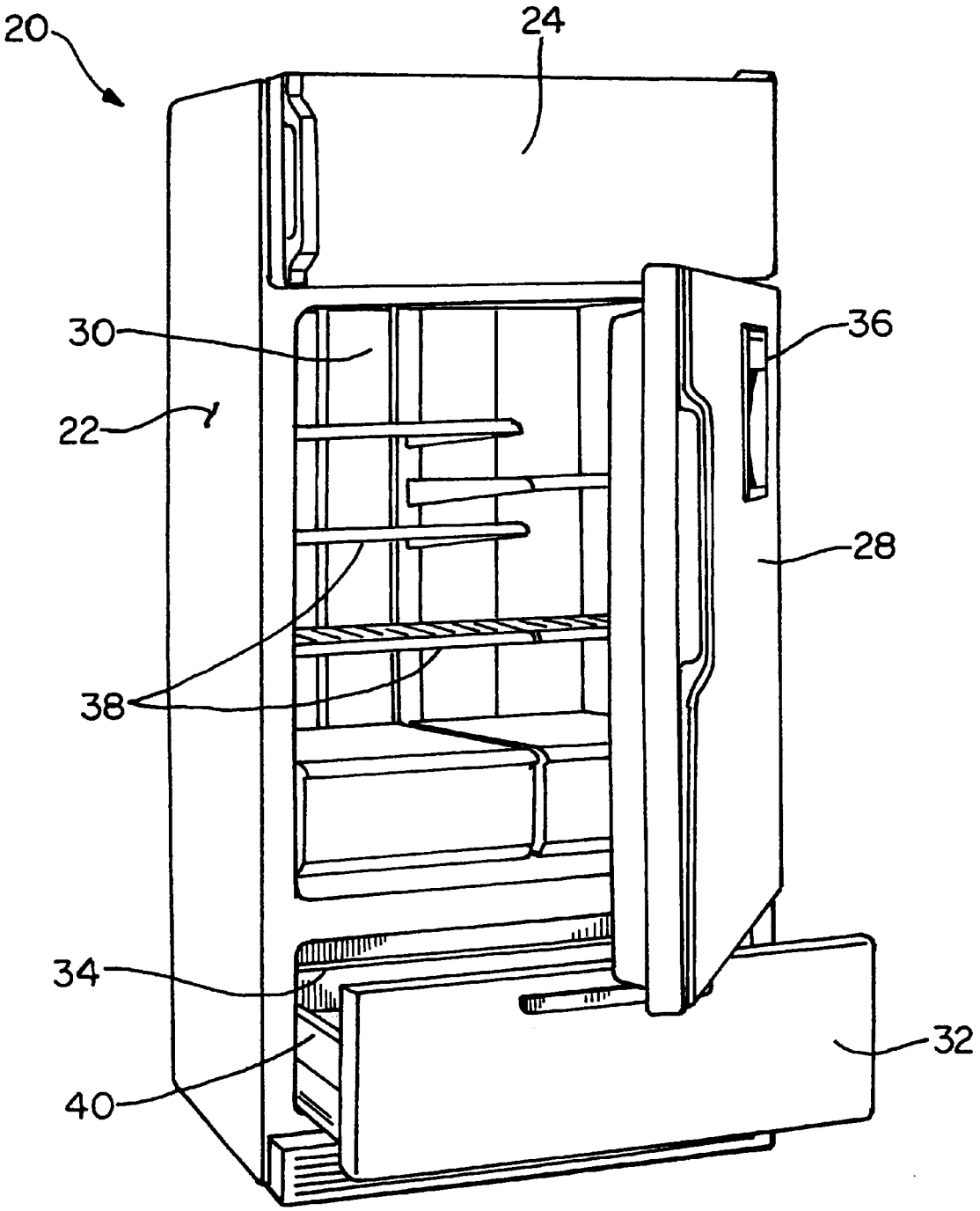
FIG. 1 is a perspective view of the refrigerator appliance embodying the principles of the present invention.
Figure 2:
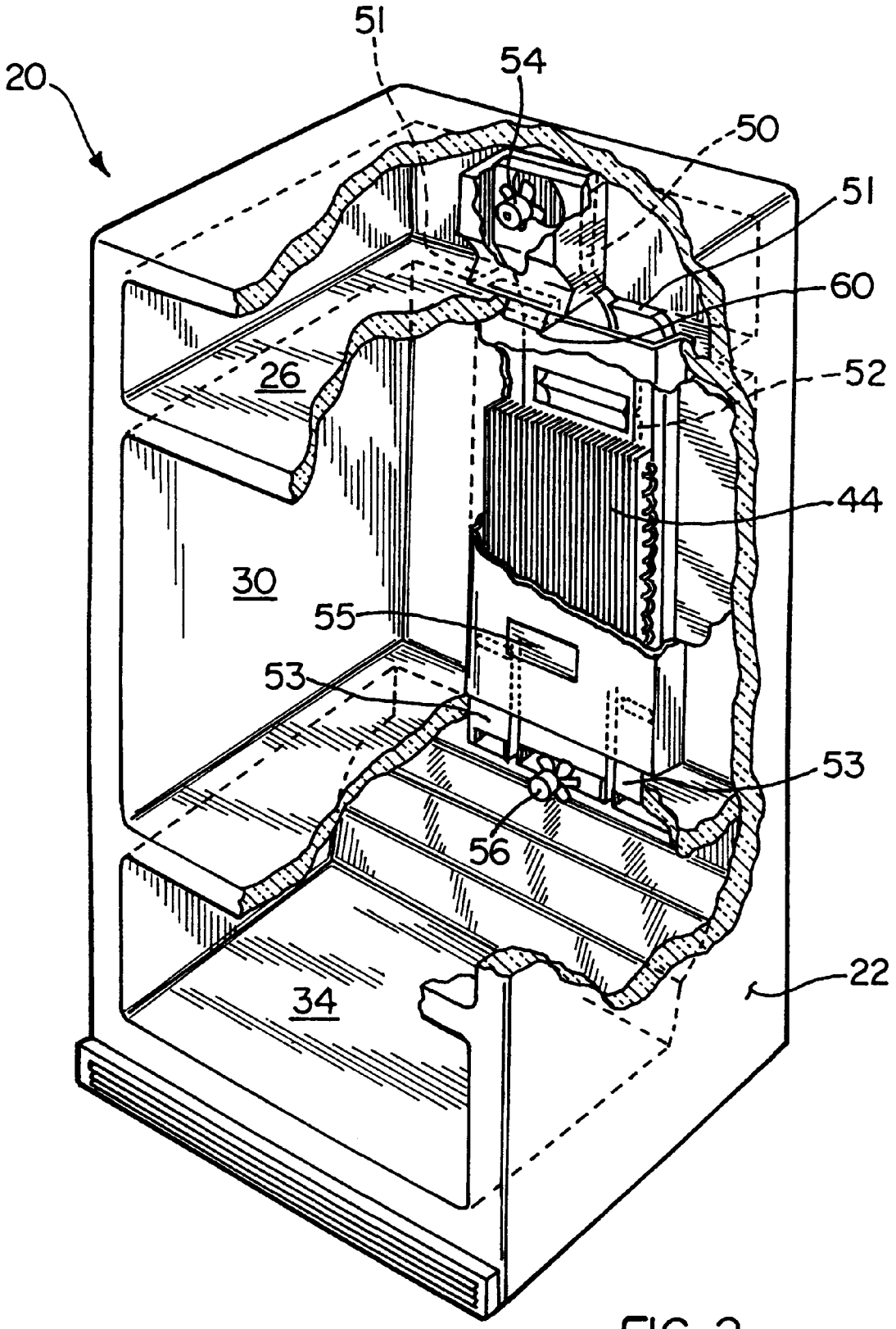
FIG. 2 is a perspective view of the refrigerator of FIG. 1 having the doors removed and being partially cut-away such that the interior components may be shown.

In FIG. 1, there is shown generally a refrigeration appliance at 20, which comprises an exterior cabinet 22 having a first openable door 24 to expose a first interior compartment 26 (FIG.2), a second openable door 28 to expose a second interior compartment 30 (FIG.2) and a third openable door 32 to expose a third interior compartment 34 (FIG.2). The first and second doors 24 and 28 are preferably hingedly attached to the exterior cabinet along one side. The third door 32 is preferably attached to a slidable drawer 40. The second door 28 can support a dispenser assembly 36 such that ice and water can be selectively dispensed through the front surface of the second door 28. Within the first and second cabinets, there can be one or more shelves 38 for supporting food items.

The present invention contemplates that the first compartment 26 is a top freezer compartment maintained at approximately −8° to −14° C. The second compartment 30 is a fresh food compartment maintained at approximately 1° to 5° C. The third compartment 34 may preferably be maintained as a freezer compartment. This cabinet configuration provides several benefits. The third compartment 34 is larger in volume than the first compartment 26 and can be used as a "deep freeze" for receiving less frequently used frozen food items. A pull-out drawer type compartment facilitates the storage of items in the bottom compartment 34. Moreover, by providing a freezer area beneath the second compartment 30, the relative height of the bottom wall of second compartment is raised whereby the ease of accessing the interior of the fresh food compartment is increased.

Figure 3A:
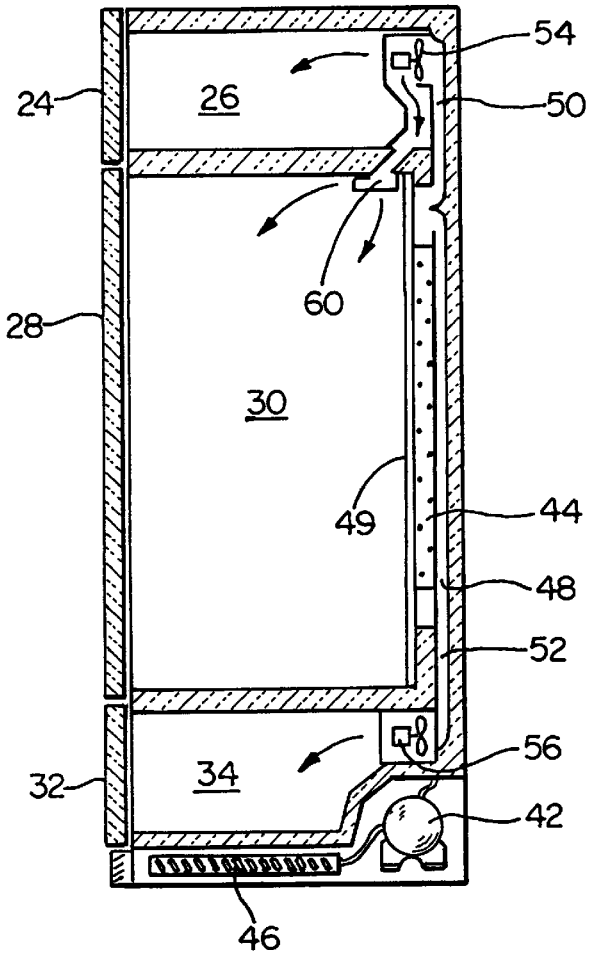
FIG. 3*a* is a side sectional view of the refrigerator of FIG. 1 showing the cold air supply system of the present invention.
Figure 3B:
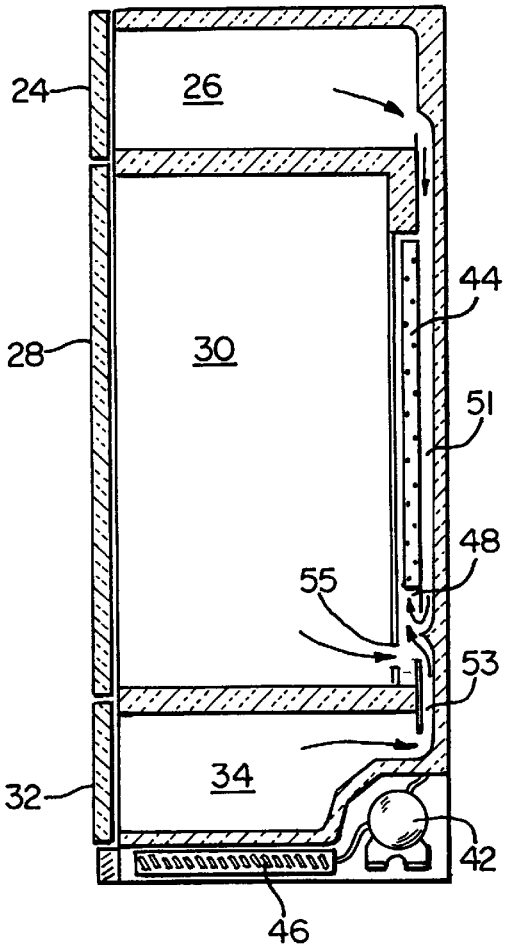
FIG. 3*b* is a side sectional view of the refrigerator of FIG. 1 showing the cold air return system of the present invention.

FIGS. 2, 3*a* and 3*b*, illustrate the refrigerator appliance 20 in greater detail. An air cooling system comprises a compressor 42 that operates to move refrigerant through an evaporator 44 and a condenser 46 for cooling the evaporator 44 as is known. The evaporator 44 is disposed at the rear of the second compartment 30 within an evaporator chamber 48 behind a rear wall 49.

Cooling of the respective compartments is accomplished by a cooling system that generates cooled air which is circulated to the compartments by an air control system as called for by a microprocessor control having one or more temperature sensors in the compartments. To accomplish this end, a supply duct system comprising a first supply duct 50 and second supply duct 52 connect the supply side of the evaporator chamber 48 with the first and third compartments 26 and 34, respectively. Referring to FIG. 3, a first fan 54 selectively controls air flow into the first and second compartments 26 and 30 and a second fan 56 selectively controls the air flow into the third compartment 34. Parallel return ducts disposed on opposite sides of the supply duct, each comprise a first return duct 51, a second return duct 53 along with opening 55 to connect the first, third and second compartments 26, 34 and 30, respectively, with the return side of the evaporator chamber 48.

A first temperature sensor 57 (FIG. 5), such as a thermistor, is disposed in the second compartment. The temperature sensor 57 provides a signal for controlling the energization of the compressor 42 and for controlling the first fan 54 to supply cold air when cooling is required. A potentiometer 58 (FIG. 5) allows the user to set the temperature in the first compartment 26. A manually operated baffle 60 is provided between the first and second compartments to regulate the temperature of the second compartment 30, as can be understood by one skilled in the art.

A second temperature sensor 62 (FIG. 5), such as a thermistor, is disposed in the third compartment 34. The temperature sensor 62 provides a signal for controlling the energization of the compressor 42 and for controlling the second fan 56 to supply cold air when cooling is required. The temperature sensor 62 is responsive to a second potentiometer 64 (FIG. 5) such that the user may set the temperature within the third compartment 34.

The fans 54 and 56 can be operated to preclude the need for any automatic baffles in the ducts 50 and 52. As can be understood by one skilled in the art, when either fan 54 or 56 is operated alone, it will draw air across the evaporator 44. Unfortunately, if the first fan 54 is operated alone it will also draw air from the third compartment 34 through the supply duct 52. Similarly, if the second fan 56 is operated alone, it will draw air from the first and second compartments 26 and 30 through the supply duct 50.

Figure 4:
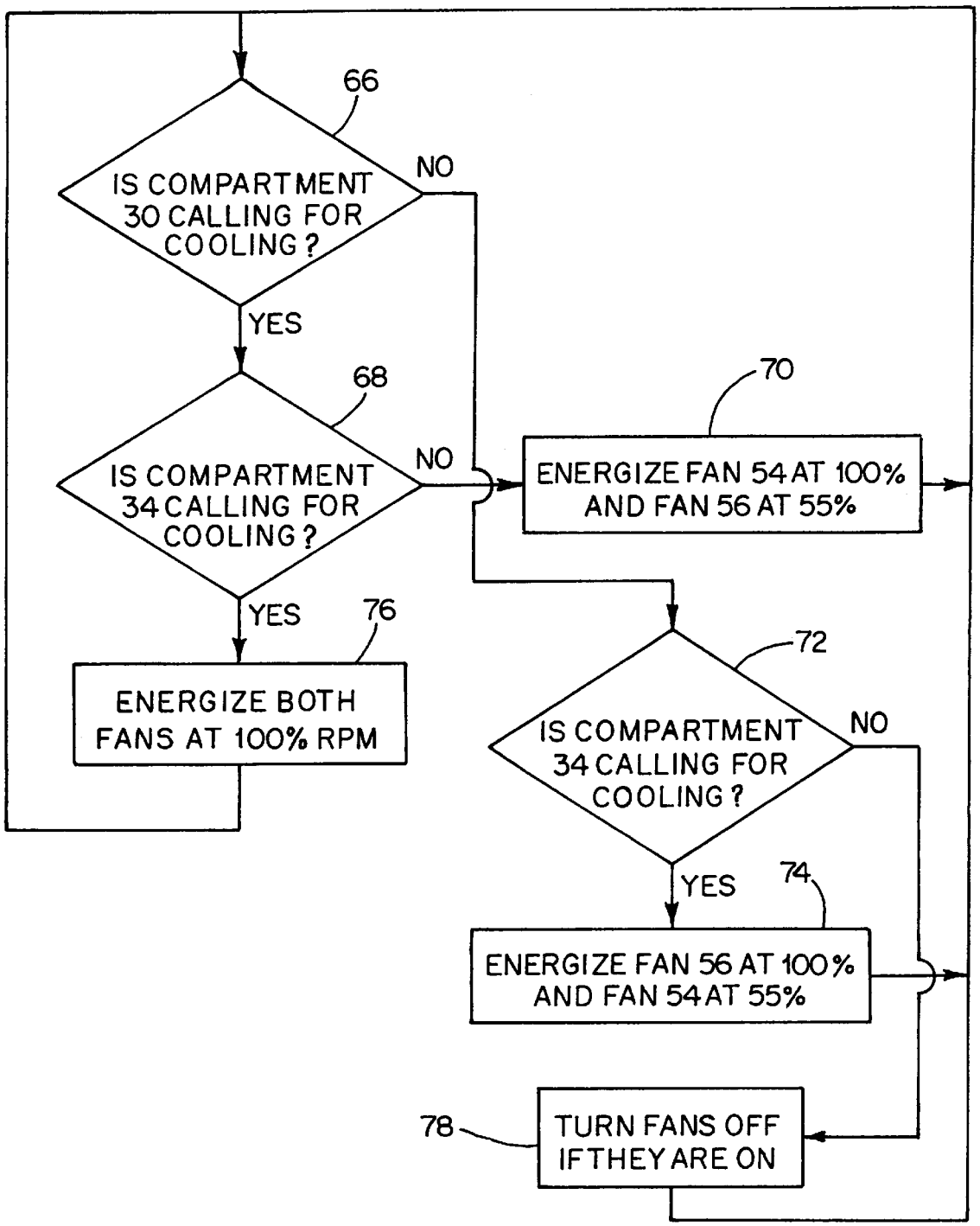
FIG. 4 is a flow chart illustrating the control logic for cooling the compartments of the refrigerator of FIG. 1.

This condition—the drawing of air from the opposite compartment—if allowed to occur, would cause inefficient temperature control of the compartments. Accordingly, the fans 54 and 56 are operated in conjunction to prevent this condition from occurring. As shown in FIG. 4 in steps 66, 68 and 70, when the second compartment 30 alone calls for cooling the first fan 54 is energized. However, to preclude air from being drawn out of compartment 34, the second fan 56 is also energized, but at a predetermined reduced speed approximately 55% of the normal fan speed. This reduced speed is just sufficient to create a back pressure in duct 52 such that no air is drawn out of the third compartment 34 and no air is moved into the third compartment 34.

Similarly, when the third compartment 34 alone calls for cooling, as shown in steps 66, 72 and 74, the second fan 56 is energized. However, to preclude air from being drawn out of compartments 26 and 30, the first fan 54 is also energized, but at a predetermined reduced speed—approximately 55% of the normal fan speed. This reduced speed is just sufficient to create a back pressure in duct 50 such that no air is drawn out of the compartments 26 and 30 and no air is moved into the compartments 26 and 30.

If however, both compartments 34 and 36 are calling for cooling at the same time, as shown in steps 66, 68 and 76, then both fans 54 and 56 are energized simultaneously at 100% of the fan speed. In this mode, the fans simultaneously operate to draw air across the evaporator 44 and supply that air into the respective compartments.

If no cooling of either compartment is required, then both fans are de-energized, as shown in step 78.

Figure 5:
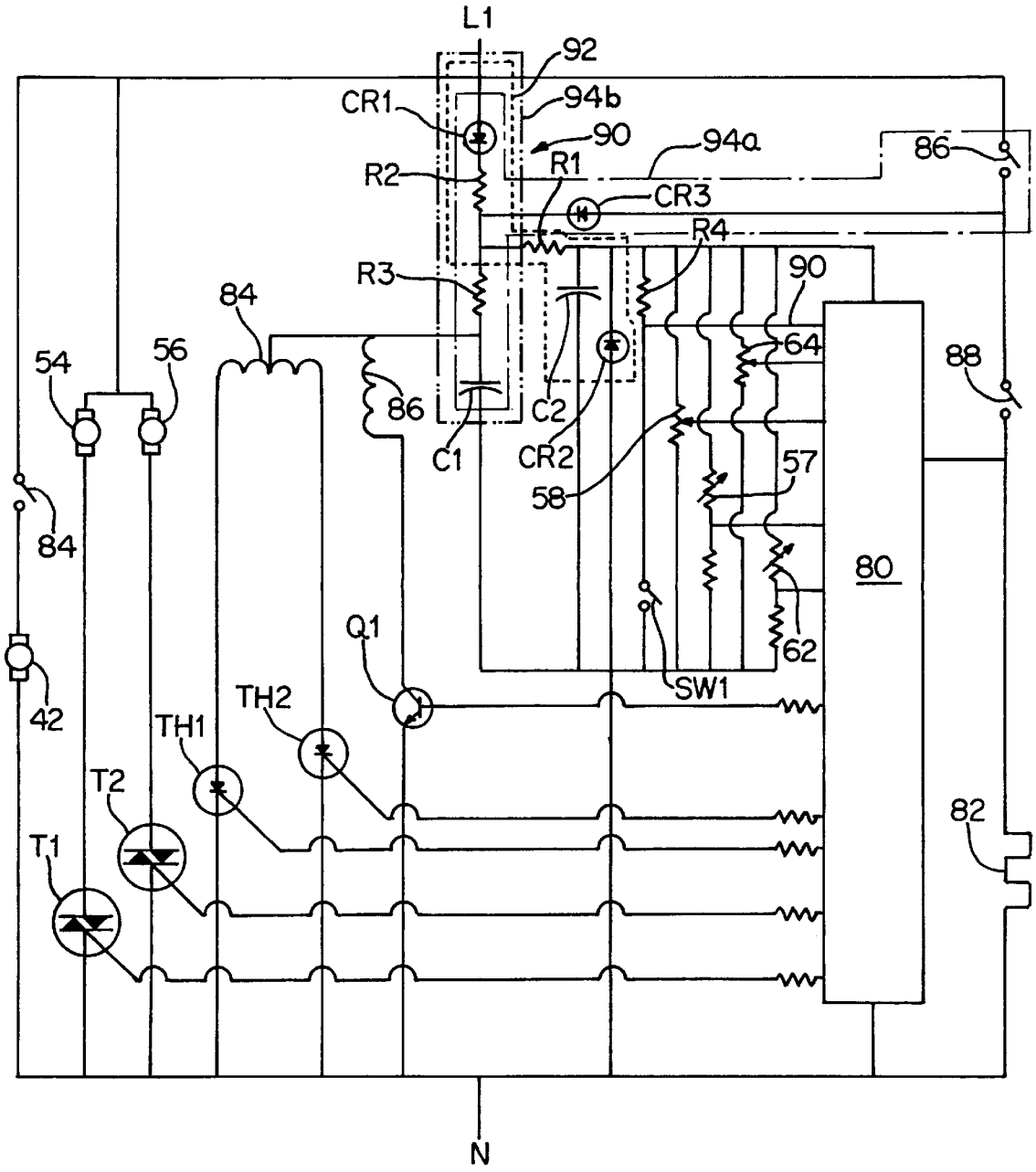
FIG. 5 is a schematic of a control circuit embodying the principles of the present invention.

In FIG. 5, there is illustrated a schematic of a circuit for carrying out the operation of the present invention. This control system for the present invention is preferably contemplated to be an expansion of the refrigerator defrost control system as disclosed in U.S. Pat. No. 5,363,667 to Janke et al., herein incorporated by reference. By adding the control components of the present invention to the Janke et al. defrost system, a complete refrigerator controller can be provided.

As illustrated, the control circuit includes a microprocessor 80 operatively connected with various circuit elements to effect the operation of the refrigerator 20. In addition to the compressor 42 and the two fans 54 and 56, the controller 80 operates to control a defrost heater 82 for periodically defrosting the evaporator 44, as described in the Janke et al. reference. A latching relay 84 is provided for selectively energizing and de-energizing the compressor 42 while a heater relay 86 is controlled for selectively energizing the defrost heater 82. An end-of-defrost thermostat 88 is provided for turning the defrost heater 82 off upon completion of defrost. The compressor relay is preferably a magnetic latching type relay which changes states in response to a short burst of energy but does not require continuing voltage to maintain a closed position. In this manner, latching relays of this type consume very little energy.

In FIG. 5, power from L1 is converted to DC by power supply circuit 90. Power supply 90 essentially comprises three power supplies: a logic power supply 92 made up of a resistor R1, Zener diode CR2 and capacitor C2; a defrost relay power supply 94*a* including resistor R3, capacitor C1, diode CR3 and relay contact 86; and a compressor relay power supply 94*b* made up of resistor R3 and capacitor C1, which is a subset of the defrost relay power supply 94*a*. As illustrated, resistor R2 and diode CR1 are common to all of the power supplies. Power supply 92 and 94*a* are substantially similar to the power supply disclosed in the Janke et al. reference.

The logic power supply 92 generates a DC operating voltage approximately equal to 5 volts which enables the microprocessor 80 to run. The power supply 92 further provides power for operating the thermistors 57 and 62 and potentiometers 58 and 64 such that the temperatures in the compartments 26, 30 and 34 may be controlled.

The defrost relay power supply 94*a* capacitor C1 charges to a significantly higher voltage than the relay coil rating to assure positive actuation. The increased current demanded to keep the relay energized is now supplied by diode CR3 and closed relay contact 86. The compressor relay power supply 94*b* capacitor C1 accumulates a charge sufficient to operate this relay when it's charge is totally dumped through the relay coil via H1 or TH2. Because resistor R2 is large and contact 86 is not actuated, capacitor C1 depletes to a low enough level for the thyristor to commutate off. The unique power supply requirements of the magnetic latching relay have been met without adding a single additional component to the power supply.

Referring back to FIG. 4 in conjunction with FIG. 5, the operation of the control circuit may be understood. The microprocessor receives signal inputs from the temperature sensors or thermistors 57 and 62 and from the potentiometers 58 and 64 for controlling the compartment temperatures. As discussed above, the first thermistor 57 is located in the first compartment 26 and the second thermistor 62 is located in the third compartment 34.

When the signals from the temperature sensor 57 and potentiometer 58 indicate the first and second compartments 26 and 30 need cooling, the microprocessor 80 operates to energize fan 54 at high speed and fan 56 at a low speed, approximately 55% of the high speed. Preferably the fans 54 and 56 are shaded pole motors which may be controlled by their respective triacs T1 and T2. Accordingly, the microprocessor operates fan 54 at full speed by firing triac T1 to deliver a full 360° of power and operates fan 56 at the low speed by delay firing triac T2, to deliver less than 360° of power. The compressor 42 is also energized by momentarily firing a first thyrister TH1 which provides a short burst of energy from power supply 94*b* to the latching relay 84 such that the relay is closed thereby connecting line L1 with the compressor 42. When the compartments no longer need cooling, the microprocessor stops firing triacs T1 and T2 thereby de-energizing fans 54 and 56. Moreover, a second thyrister TH2 is fired providing a short burst of energy from the power supply 94*b* for reopening the latching relay 84 thereby de-energizing the compressor 42.

When the signals from the temperature sensor 62 and potentiometer 64 indicate that the third compartment 34 needs cooling, the microprocessor 80 operates in a similar fashion as above to energize fan 56 at full speed by firing triac T2 to deliver full power and fan 54 at the low speed by delay firing triac T1 to deliver reduced power. The compressor 42 is switched on and off by controlling the latching relay 84. Similarly, when all compartments are calling for cooling, both fans 54 and 56 are energized at the full speed and the compressor is energized through operation of the relay 84.

The control circuit of FIG. 5 also allows for compartment 34 to be convertible between a freezer compartment and a fresh food compartment. This feature offers the user great flexibility in how the drawer-like third compartment 34 is utilized.

As discussed above, the third compartment 34 is controlled responsive to the signals from thermistor 62 and potentiometer 64. As is known, a potentiometer allows users to vary the temperature setting within a finite limit. When operating the third compartment 34 as a freezer, the potentiometer 64 allows the user to vary the temperature between −20° C. to −14° C. and the thermistor 62 operates to sense temperature variations within that range. When it is desired to use the third compartment 34 as a fresh food compartment, calibration switch SW1 is closed, connecting resister R4 to N. This is sensed by the microprocessor 80 over line 90. In response, the microprocessor 80 shifts the calibration of the thermistor 62 and potentiometer 64 such that they operate within a range of 1° C. to 5° C.

The calibration switch SW1 is preferably a push/push type switch such as an Omron model A3A The status of the switch is visible to the operator via a mechanically activated flag disposed within the switch. The switch is pushed to close the switch and pushed again to open the switch. Use of a push/push type switch with a mechanical status flag is desirable because no power is required to operate the user indicator. As preferably contemplated by the inventors, the power supply 92 is limited, being configured approximately as a ⅓ watt power supply. Accordingly, supporting a status signal switch which requires power, such as a switch having an LED status signal, is undesirable.

Figure 6:
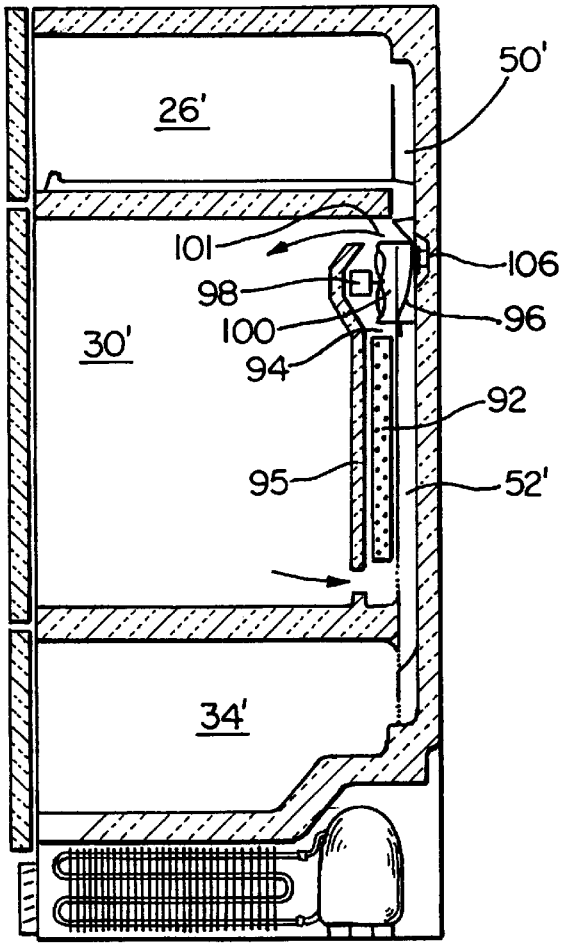
FIG. 6 is a side sectional view of a refrigerator illustrating a second embodiment of the present invention.
Figure 7:
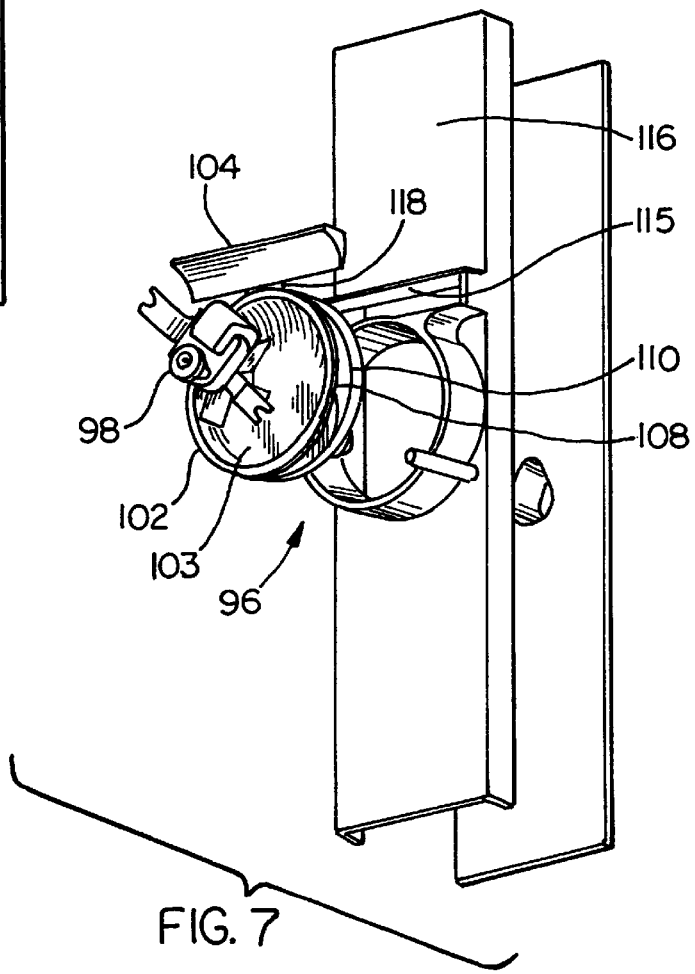
FIG. 7 is an exploded view of a baffle assembly for the second embodiment of the present invention.

FIG. 6 illustrates a second embodiment of the present invention. In this configuration, a refrigerator 20' is provided with a first top compartment 26', a second middle compartment 30' and a third bottom compartment 34'. The compartment 30 may incorporate a multi-temperature evaporator 92, such as disclosed in U.S. Pat. No. 5,231,847, Cur et al. herein incorporated by reference, which operates to cool the compartments.

The evaporator 92 may be operated at a relatively high evaporation pressure, such as 17–21 PSIG and at a relatively low pressure, such as 0–2 PSIG. At the high pressure the evaporator is maintained at approximately −9° C. and is suitable for cooling a fresh food compartment within a range of 1° C. to 5° C. and at the low evaporation pressure the evaporator is maintained at approximately −27° C. and is suitable for cooling a freezer compartment within a range of −14° C. to −20° C.

The evaporator 92 is disposed in an evaporator chamber 94 behind a back wall 95 of the middle compartment 30'. A fan 98 is disposed at the outlet end of the evaporator chamber for circulating air over the evaporator 92 and supplying the cooled air to the compartments. An automatic baffle assembly 96 is positioned within a fan plenum 100 down stream of the fan for selectively directing cooled air into the top compartment 26' through duct 50', the bottom compartment 30' through duct 52', or to the middle compartment 30' through duct 101.

Turning now to FIGS. 7, 8*a*, 8*b*, 9*a*, 9*b*, 9*c* and 10, the construction and operation of the baffle 96 may be understood. The damper 96 is a multi-part assembly comprising a scoop-like air flow director or main damper 102 and a slide damper 104. The main damper is rotatably driven by a relatively low speed drive motor 106. The main damper 102 includes a first straight annular track 108 and a second helical annular track 110 wherein both tracks are disposed about the outer periphery of the main damper 102. The tracks join each other at a junction point 112. Located at the junction point 112 is a rotatable track switching device 114. The switching device 114 may be switchable between a first position and a second position shown in FIGS. 8*a* and 8*b*, respectively.

The slide damper 104 is supported adjacent the main damper 102 within a guide sleeve 115. The guide sleeve 115 may preferably be part of a housing 116 which forms the ducts through which the compartments are supplied with cooled air. The slide damper 104 includes a drive pin 118 which is received into the tracks 108 and 110 formed about the main damper 102. When the drive motor 106 is energized, the main damper is rotated in a direction indicated by arrow 120. The drive pin 118, extending from the slide damper 104, is prevented from rotating with the main damper and accordingly has a relative motion through the rotating tracks 108 and 110 in the direction indicated by arrow 122.

Figure 8A:
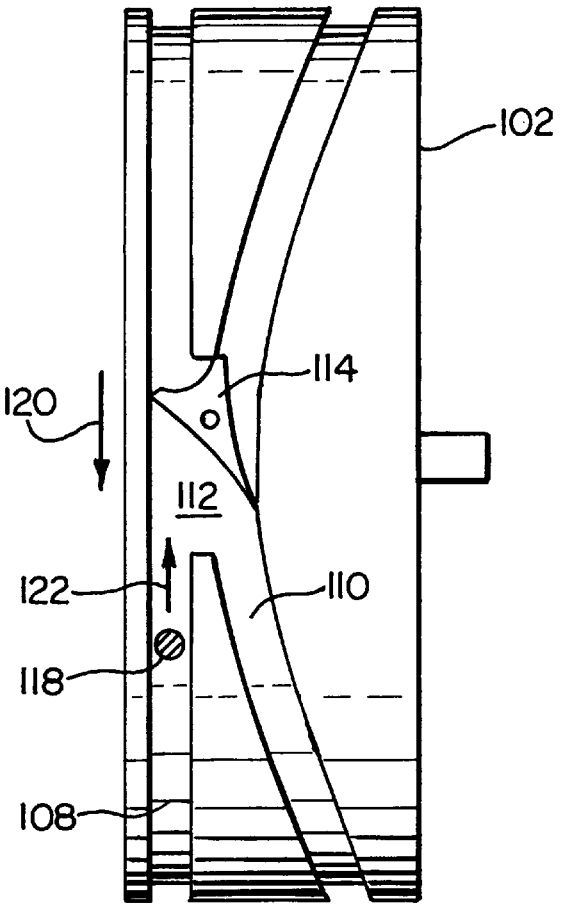
FIG. 8*a* is a top view of a main damper of the baffle assembly shown in FIG. 7 showing a switching device in a first position.
Figure 8B:
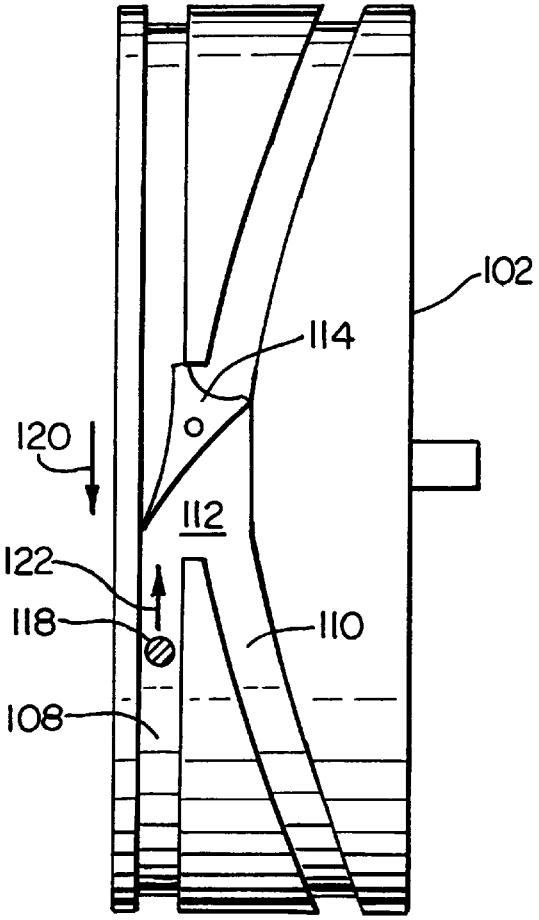
FIG. 8*b* is a top view of the main damper of the baffle assembly shown in FIG. 7 showing the switching device in a second position.

As best seen in FIG. 8*a*, when the pin 118, moving through the straight track 108, contacts the switching device 114 positioned in its first position, the pin 118 is guided into continued relative movement within the straight track 108. Upon movement past the switching device 114, the pin causes the switching device to move to its second position shown in FIG. 8*b*. Upon the subsequent rotation of the switching device 114 past the pin 118, the pin 118 is directed into the helical track 110. The helical track 110 operates as a cam on the pin 118 such that the slide damper 104 is laterally moved.

Accordingly, for every 360° rotation of the main damper, the slide damper 104 is switched between the straight track 108 and the helical track 110. When the pin 118 is positioned within the helical track 110, the slide damper 104 is moved laterally adjacent the main damper 102. For reference purposes, the slide damper position when the pin 118 is positioned within the straight track is referred to as the home position. The slide damper position when the pin 118 is positioned within the helical track at the point farthest from the straight track 102 is referred to as the middle compartment position.

Figure 9A:
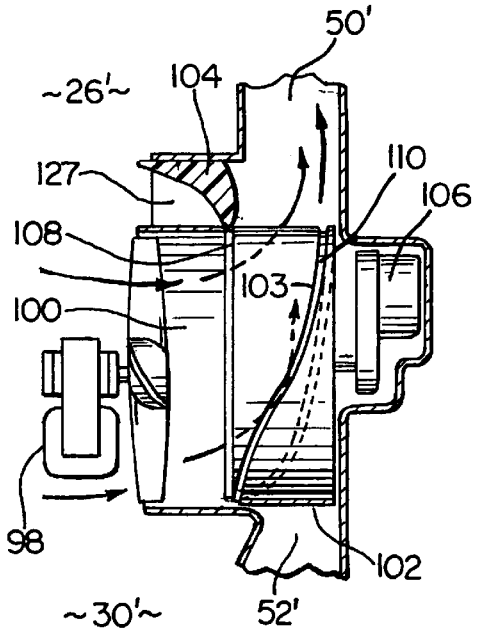
FIG. 9*a* is an enlarged, side sectional view of the assembled baffle assembly of the second embodiment showing the baffle assembly in a first position.
Figure 9C:
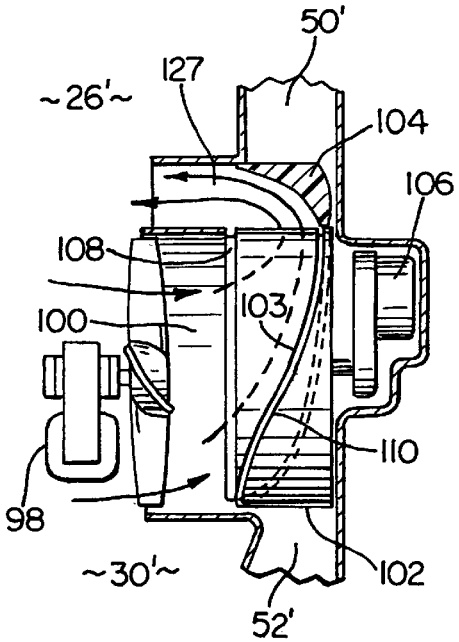
FIG. 9*c* is an enlarged, side sectional view of the assembled baffle assembly of the second embodiment showing the baffle assembly in a third position.
Figure 9B:
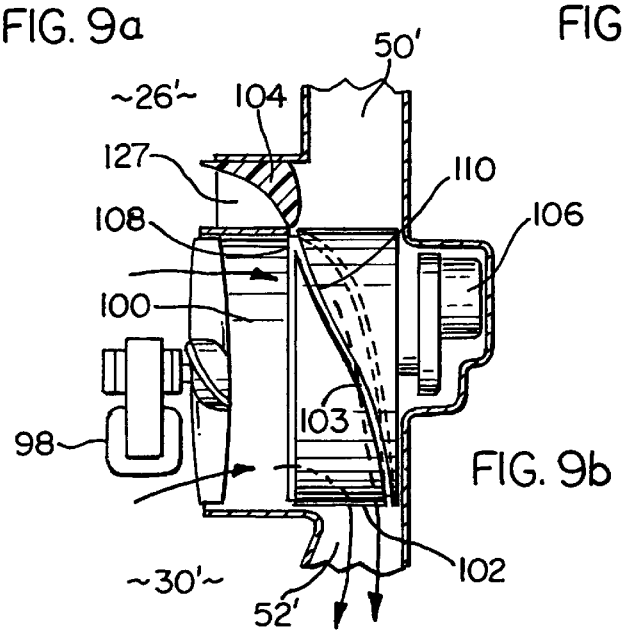
FIG. 9*b* is an enlarged, side sectional view of the assembled baffle assembly of the second embodiment showing the baffle assembly in a second position.
Figure 10:
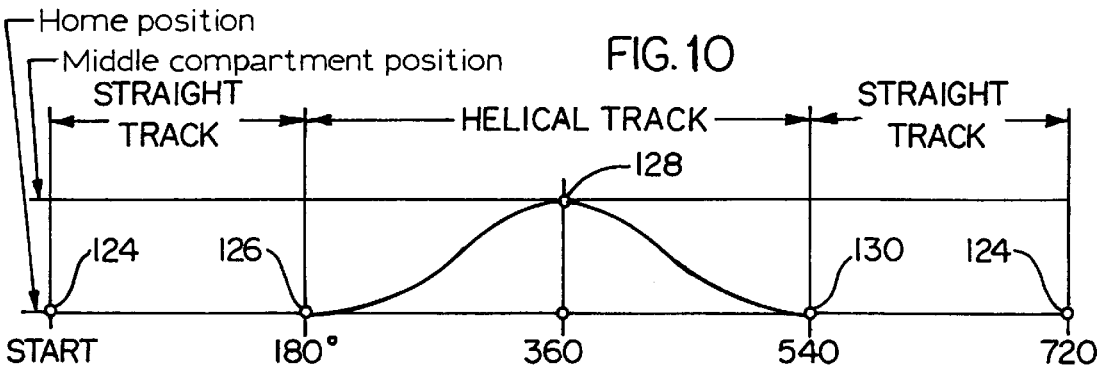
FIG. 10 is a displacement chart partially illustrating the operation of the baffle assembly of FIG. 7.

FIGS. 9*a*, 9*b* and 9*c* illustrate the operation of the baffle assembly 96. A controller (not shown) operates to energize the drive motor 106 for rotating the main damper 102 to direct cooled air to the appropriate compartment. FIG. 10 graphically illustrates the movement of the pin 118 within the straight track 108 and the helical track 110 as the main damper 102 is driven through 720° of rotation.

When the top compartment 26' calls for cooling, the main damper 102 is rotated until the slide damper 104 is in the home position and the scoop-like air control surface 103 directs air through duct 50' into the top compartment 26'. In this position, shown in FIG. 9*a*, the pin 118 is in the straight track 108, at a start point 124. The start point 124 for the pin 118 is defined as the point when the pin 118 is in the straight track 108, 180° from the switching device 114.

When the bottom compartment 34' calls for cooling, the main damper is rotated 180° until the scoop-like air control surface 103 directs air through the duct 52' into the bottom compartment 34'. This position is shown in FIG. 9*b*. Since the main baffle 102 has only been driven 180°, the slide baffle remains in the straight track 108 but the pin 118 is now in a position 126 adjacent the switching device 114.

When the middle compartment calls for cooling or the control calls for defrosting, the main damper is rotated forward another 180° until the scoop-like air control surface 103 directs air upward. This additional rotation of the main damper 102 moves the switching device 114 past the pin 118 wherein the pin 118 is directed into the helical track 110. Accordingly, during the 180° forward rotation of the main baffle 102, the slide baffle 104 is moved into its middle compartment position under the cam-like urgings of the helical track 110 operating on the pin 118 such that cooled air is directed through duct 127 into the middle compartment 30'. After 180° forward rotation of the main baffle 102, the pin is in position 128 within the helical track 110. Defrosting is also done in this position so as to minimize the heating of the upper compartment by natural convection of the warm moisture laden air rising through the supply duct if it were not directed to the middle compartment. Additional benefits are possible if the defrost is accomplished via circulation of the middle compartments 1° C. to 5° C. air through the evaporator plenum. The moisture in the form of frost & ice accumulated on the evaporator is returned to the middle compartment which is known to significantly reduce dehydration of fresh food stuffs and also the cooling potential of the frost and ice is utilized to maintain the middle compartment temperature whereas present state of the art defrosting causes significant excursions in the bulk temperature of the compartment adjacent to the evaporator plenum.

Rotating the main damper 102 another 180° forward, positions the scoop-like air control surface 103 to again direct air through the duct 52' toward the bottom compartment 34' as shown in FIG. 9*b*. This rotation of the mainbaffle 102 positions the pin 118 at position 130 which is at the junction point 112 within the tracks adjacent the switching device 114.

Upon subsequent rotation of the main damper 102, the switching device 114 directs the pin 118 into the straight track 108. Accordingly, when the main damper 102 is again rotated 180° forward, the main damper 102 and the slide damper 104 are positioned at their original start position as shown in FIG. 9*a* wherein the scoop-like air control surface 103 directs air through duct 50' into the top compartment 26'. In this position, the pin 118 is in the straight track 108, at the start point 124.

It can be seen, therefore, that by selectively rotating the main baffle 102, cooled air can be selectively supplied to either the top, middle or bottom compartment 26', 30' and 34', respectively. The inventors have contemplated a control scheme utilizing a plurality of limit switches for signaling the respective positions of the main damper 102 and the slide damper 104. The inventors have preferably contemplated a control scheme utilizing a single limit switch and the synchronous operation of the damper drive motor 106 along with the inherent timing capability of a microprocessor based control for signaling the home position of the main damper 102 and the slide damper 104 for every 720° of rotation. In this manner, a controller, responsive to cooling demand signals from either the top, middle or bottom compartments, can energize the drive motor 106 to rotate the main damper 102 for selectively positioning the dampers in the correct positions for supplying cooled air to the appropriate compartment.

Figure 11:
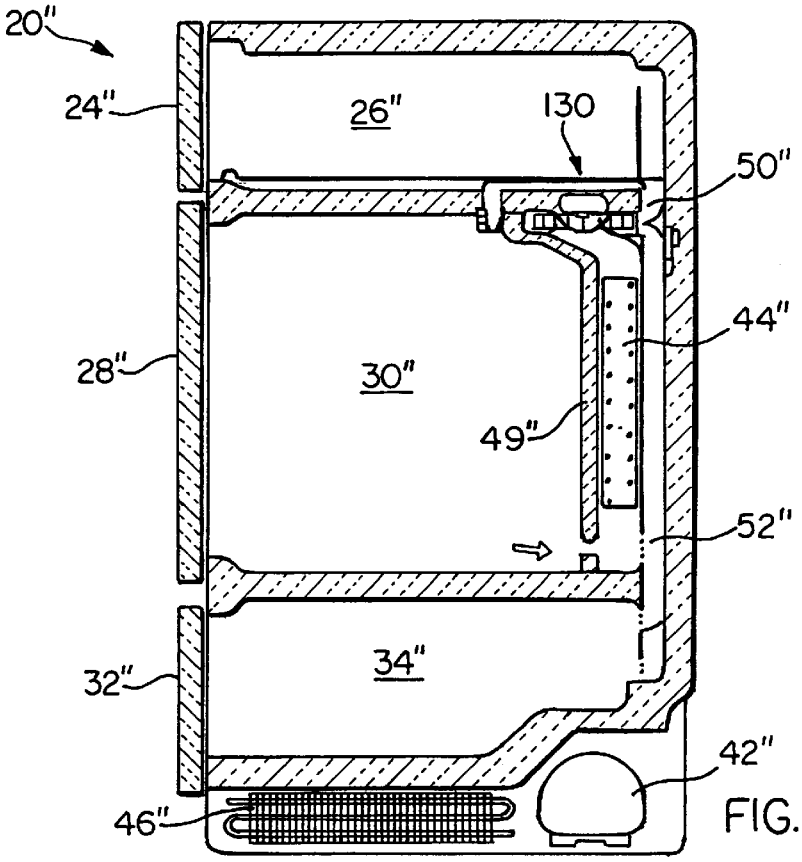
FIG. 11 is a side view of the refrigerator of FIG. 1 showing a second baffle assembly.
Figure 12:
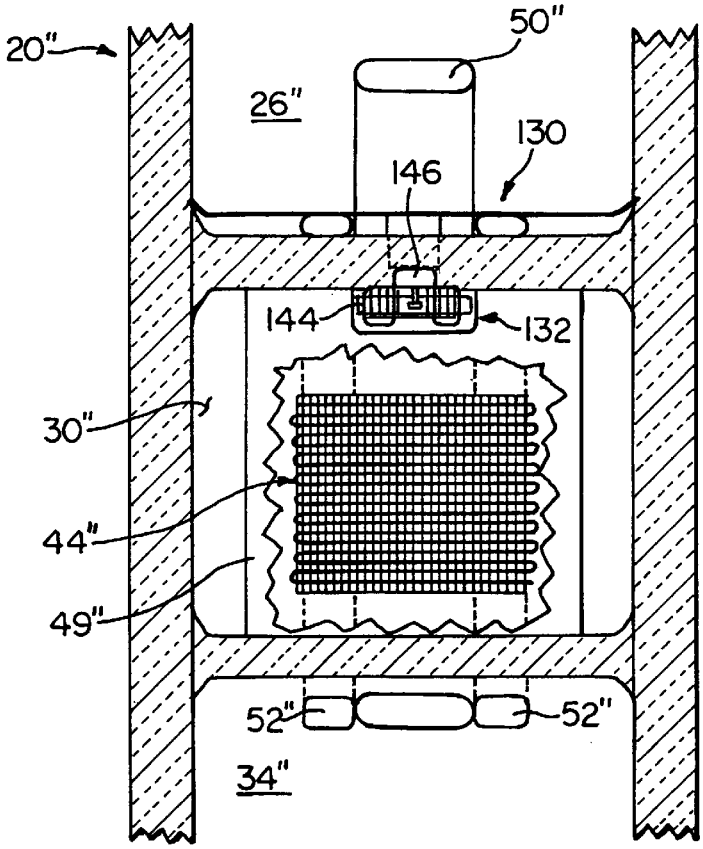
FIG. 12 is a frontal view of the refrigerator and second baffle assembly of FIG. 11.
Figure 13:
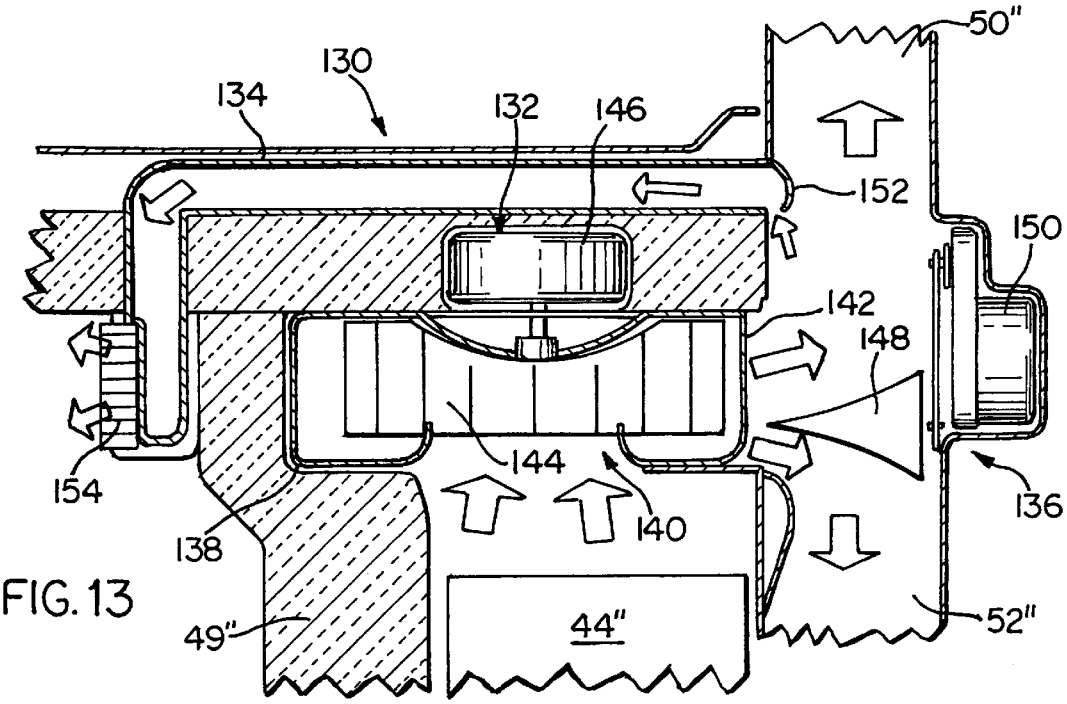
FIG. 13 is an enlarged view of the second baffle assembly of FIG. 11.

FIGS. 11 through 13 illustrate a second embodiment baffle assembly 130 for the refrigerator according to the invention. The refrigerator is substantially identical to the refrigerator disclosed in the previous figures. Therefore, similar parts will be identified with similar numbers followed by " suffix. Unlike the previous baffle assembly 96, which direct that substantially all of the air flow across the evaporator tube be directed to the demanding compartment, the baffle assembly 130 is a proportional baffle assembly proportionally divides the air flow between the demanding compartments as a function of the level of demand.

The baffle assembly 130 comprises a blower assembly 132 positioned above the evaporator and mounted to the wall separating the first compartment 26" from the second compartment 30". The baffle assembly 130 also comprises a fresh food air duct extending from duct 50" into the second compartment 30". The baffle assembly 130 further comprises a moveable damper assembly 148 positioned at the junction of ducts 50" and 52". The blower assembly 132 draws air across the evaporator 44" and exhausts the cooled air into the junction of the ducts 50" and 52". The deflector assembly 148 controls the proportion of the air exhausted by the blower assembly to the ducts 50" and 52". A portion of the air exhausted into the duct 50" is caught by the fresh food air duct 134 and directed into the second compartment 30".

In greater detail, the blower assembly 132 comprises a housing 138 having an inlet 140 and an outlet 142. A fan blade 144 is positioned within the housing 138 and operably connected to an electric motor 146 for turning the fan blade 144 in response to an input from the control system of the refrigerator. Upon operation of the motor, the fan blade 144 is rotated to draw air across the evaporator and exhausts the cooled air through the exhaust opening 142 into the junction of duct 50" and duct 52".

The deflector assembly 136 comprises a deflector 148 operably coupled to an electric motor 150, having a limit switch (not shown). The deflector 148 is moved by the electric motor 150 between a predetermined range which generally coincides with the height of the exhaust opening 142. In this way, the electric motor can move the deflector 148 to various positions with respect to the exhaust opening 142 to control the proportion of air exiting the exhaust opening 142 that is deflected to the duct 50" and duct 52", respectively. The limit switch permits the refrigerator controller to determine the position of the deflector.

The fresh food supply duct 134 has at one end an air scoop 152 extending into the duct 50" to collect air and redirect it to the second compartment 30. The other end of the fresh food air supply 134 opens into the second compartment 30 and is closed by a manual damper/diffuser 154. The manual damper/diffuser works in the traditional way.

In operation, the controller initially calibrates the position of the damper 148 by moving it to his home state, either all the way or all the way down, which trips the limit switch. Once the controller senses a demand by one of the compartments, the fan 146 is actuated to spin the fan blade 144, which draws air across the evaporator, cools it and exhausts it through the exhaust opening 142. The air is then proportionally separated and directed into the ducts 50" and 52" by the deflector 148. The controller continues monitoring the demand by the compartments. If the demand is not satisfied by a particular compartment, the controller activates the electric motor 150 and bumps (moves the deflector a discreet amount) the deflector in a direction to increase the proportion of air flow to the compartment issuing a greater demand for more cooling. The controller continues refining the position of the deflector 148 until the air is proportionally split to a desired amount so that the demand of all of the compartments is satisfied.

Figure 14:
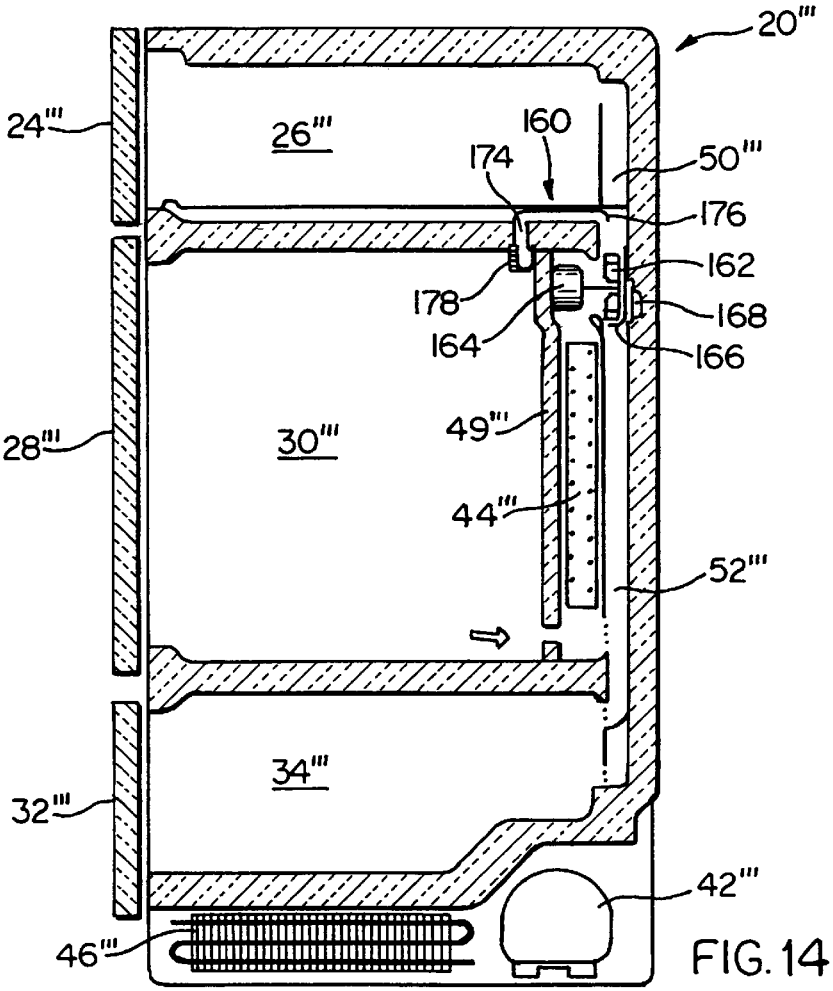
FIG. 14 is a side view of the refrigerator of FIG. 1 showing a third baffle assembly.
Figure 16:
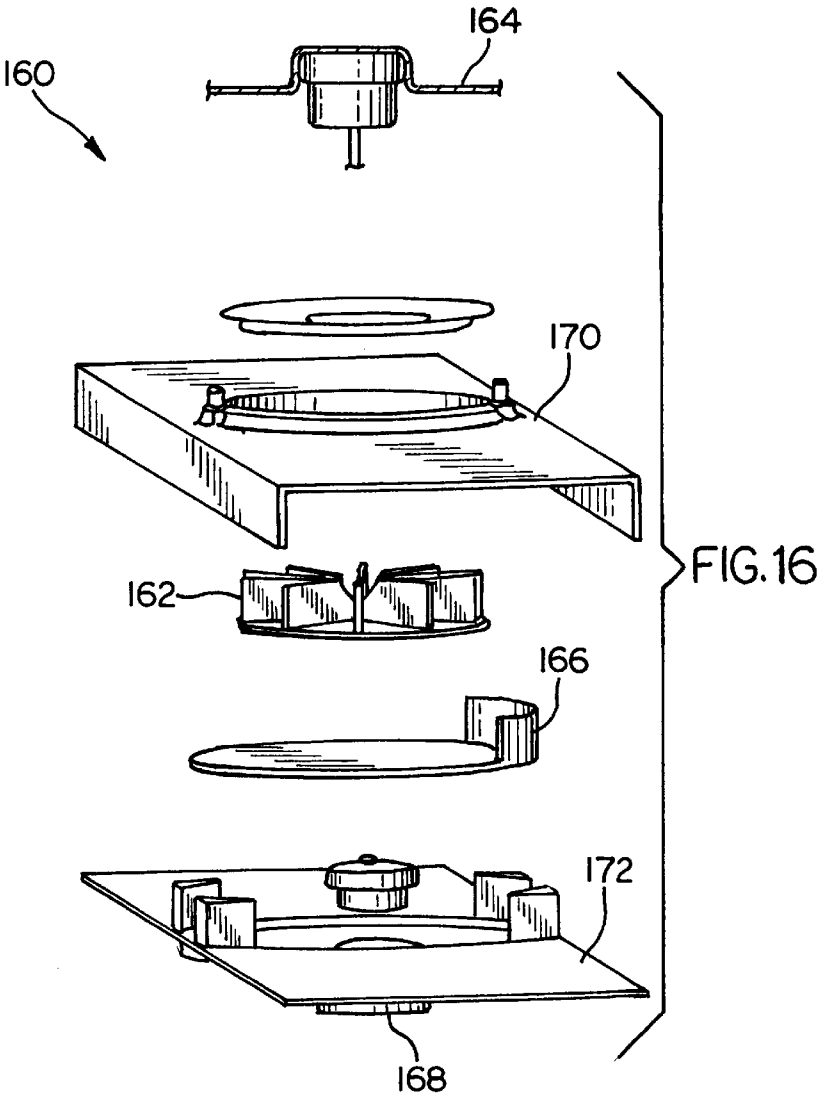
FIG. 16 is an enlarged exploded view of the third baffle assembly of FIG. 14.
Figure 15:
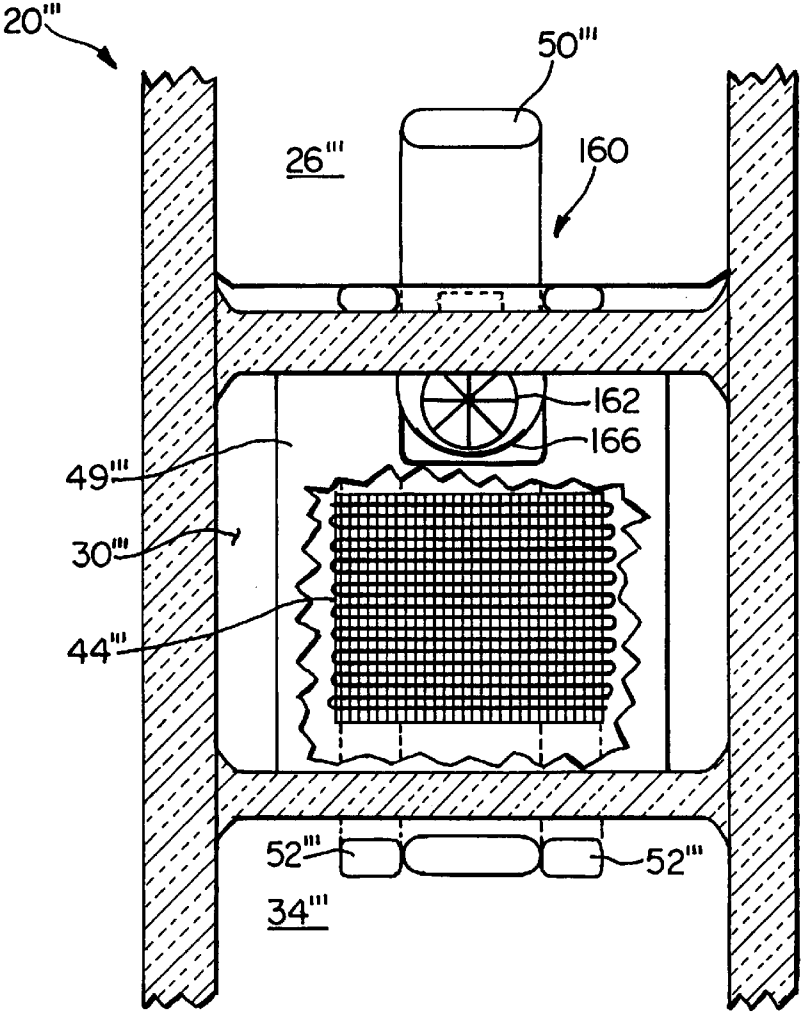
FIG. 15 is a frontal view of the refrigerator and third baffle assembly of FIG. 14.

FIGS. 14 through 16 illustrate a third embodiment damper assembly 160 for the split freezer/refrigerator according to the invention. The third embodiment damper assembly 160 is illustrated in the context of the refrigerator according to the invention. Therefore, similar parts will be identified by similar numbers with the addition of the ''' suffix. The third embodiment damper assembly 160 is similar to the second embodiment damper assembly 130 in that it proportions the air flow across the evaporator into the different compartments of the refrigerator.

The baffle assembly 160 comprises a blower assembly having a fan blade 162 and a electric motor 164. The baffle assembly 160 further comprises a deflector assembly having a rotatable air dam 166 operably connected to an timing motor 168. The baffle assembly 160 also includes a housing having an upper housing member 170 to which is mounted the electric motor 164 and a lower housing member 172 to which is rotatably mounted the air dam 166, the timing motor 168 and a limit switch (not shown). Like the second embodiment air dam, the third embodiment air dam 160 also includes an air duct 174 extending from the duct 50''' to the compartment 30'''. The fresh air duct 174 has a scoop 176 extending into the duct 50''' at one end of the air duct and a manual damper/diffuser 178 extending into the second compartment 30''' at the other end of the air duct.

The third embodiment baffle assembly 160 is positioned beneath the wall separating the first compartment 26''' from the second compartment 30''' and extends between the rear wall 49''' of the second compartment and the back wall of the refrigerator. The first housing portion 170 is mounted to the rear wall 49''' of the second compartment 30''' and the second housing portion 172 is mounted to the interior back wall of the cabinet of the refrigerator. In this position, the timing motor 164 is positioned adjacent the rear wall 49''' and above the evaporator 44''', resulting in the fan blade 162 being positioned within the ducts 50''' and 52''' at the junction thereof.

In operation, the controller initializes the position of the air dam 166 by actuating the electric motor 168 to rotate the air dam 166 until it trips the limit switch. The controller then monitors the demand from the sensors and the compartments 26''' and 34'''. Once there is a demand by one of the sensors for cooling of the compartment, the fan blade 162 is rotated by actuating the electric motor 164. The rotation of the fan blade 162 draws cool air over the evaporator 44''' where it is directed into the ducts 50''' and 52'''. The proportion of the air flow directed through the ducts 50''' and 52''' is determined by the position of the air dam 166. In its top center position, the air dam 166 effectively shuts all air flow to the first compartment 26'''. In its bottom center position, the air dam effective shuts off all air flow to the third compartment 34'''. Therefore, depending on the degree of demand from the sensors in the first and second compartments 26''' and 34''', the controller bumps (rotates the air dam 166 a discreet amount) in the direction to permit greater air flow to the compartment that has a higher demand. This process is repeated until the air flow is sufficiently proportioned to satisfy the demand from both compartments.

Figure 17:
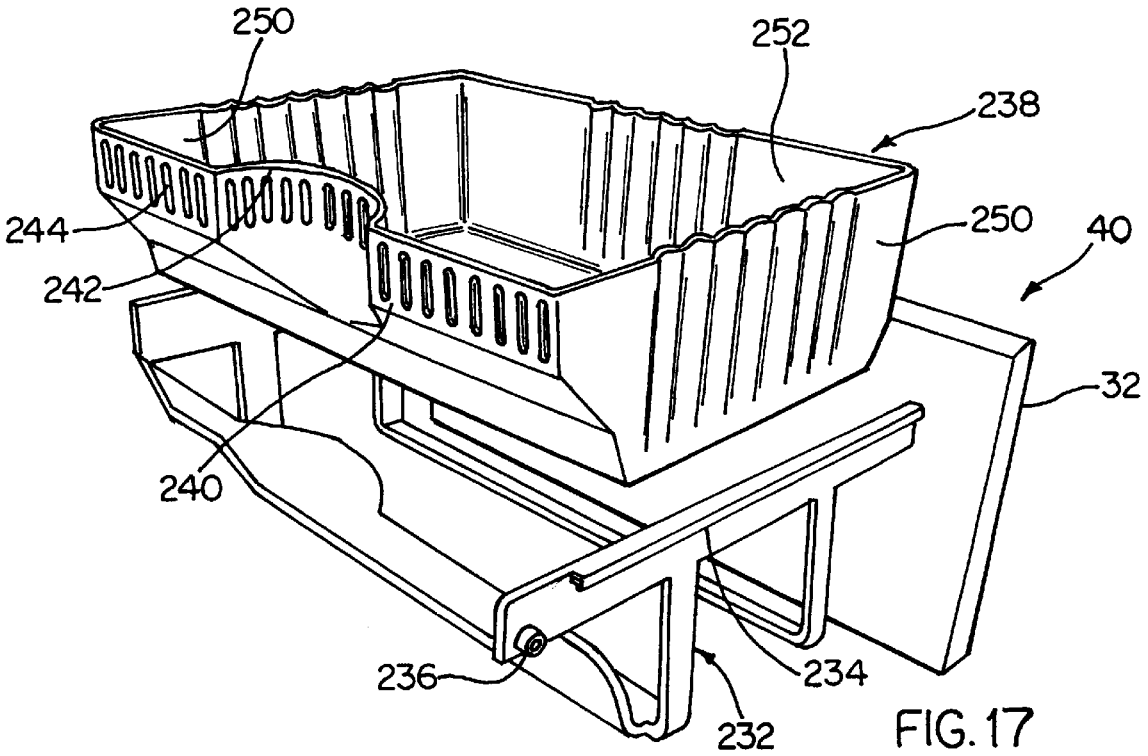
FIG. 17 is a perspective view of a drawer compartment.
Figure 18:
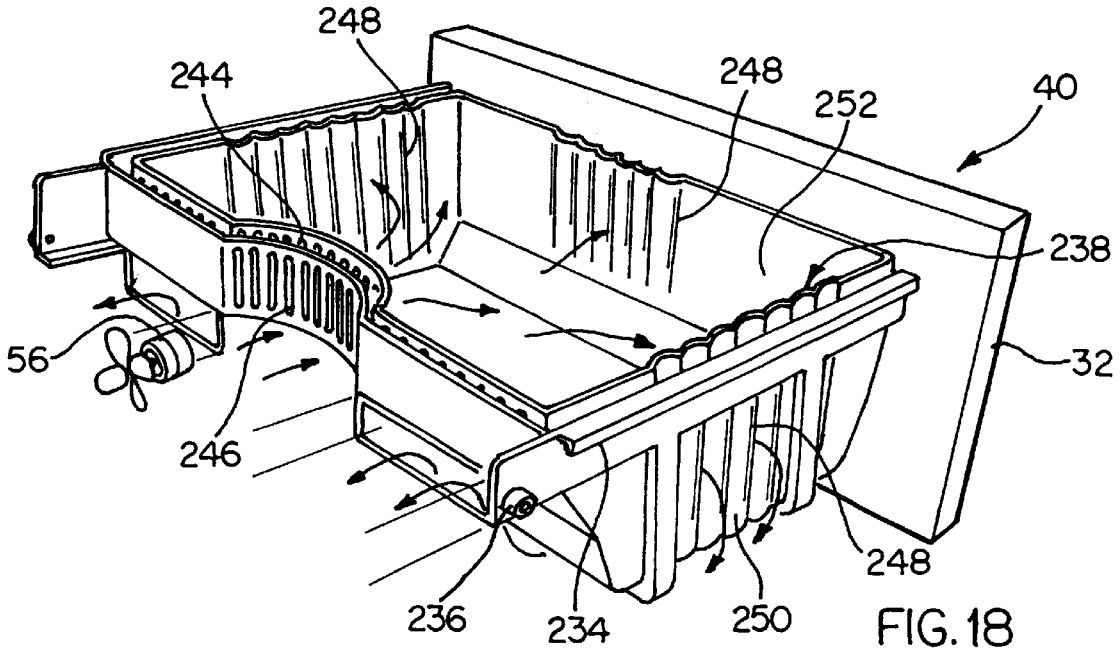
FIG. 18 is a perspective view of the drawer compartment and surrounding portions of the refrigerator of FIG. 1.

Turning now to FIGS. 17 and 18, details of the drawer 40 slidable within the third compartment 34 are shown. The drawer 40 includes a frame 232 which is connected to the third openable door 32. The frame 232 includes a pair of runner members 234 each having a roller 236. Each runner member 234 is rollingly supported by support wheels (not shown) attached to the side walls of the third compartment 34. The frame 232 supports a basket 238 having a back wall 240, side walls 250 and a front wall 252. The basket 238 is removable from the frame 232 such that the basket 238 may be easily cleaned.

As described above, cooled air is supplied into the third compartment 34 when cooling is required. The basket 238 is designed to promote optimal air flow through the drawer 40 for cooling food items disposed within the basket 238. For this purpose, the back wall 240 of the basket 238 has an inwardly radiused center portion 242 and a plurality of slit-like inlet vents 244 are provided along the top portion of the back wall 240. Air is supplied into the third compartment 34, via the supply duct 52, through a cold air outlet 246 which is matched to the radiused center portion 242 of the basket 238. The cold air flows through the inlet vents 244 and over the food items disposed within the basket 238.

To provide for air return, a plurality of slit-like outlet vents 248 are provided on the front wall 252 and the side walls 250 through which the air exits the basket 238. The return air flows along the side walls 250 and the bottom wall of the basket 238 and into the inlet of the air return duct 53. A divider (not shown) extending from either the back wall 240 of the basket 238 or the rear wall of the third compartment 34, can be provided between the supply duct 52 and return duct 53, for preventing short circuiting of the cold air flow through the drawer 40.

It can be seen, therefore, that the present invention provides a unique and advantageous configuration for a refrigerator. The configuration comprises a refrigerator having a relatively large bottom freezer compartment arranged below the fresh food compartment and a relatively small freezer compartment arranged above the fresh food compartment. Moreover, the bottom freezer compartment is preferably a unique drawer type compartment with a easy to clean removable bin. Cool air can be supplied to the compartments of the refrigerator by employing a two fan control system such that no electromechanical baffles are required—a substantial improvement over the prior art. Alternatively, cool air can be directed to the compartments of the refrigerator by use of a unique baffle system which requires only a single electromechanical device to control air flow into three different compartments—similarly a significant improvement over the prior art.

Although the present invention has been described with reference to specific embodiments, those of skill in the Art will recognize that changes may be made thereto without departing from the scope and spirit of the invention as set forth in the appended claims.

We claim:

1. A refrigerator comprising:

a cabinet having at least a first, a second, and a third compartment of which at least two are maintained at different temperatures;

a cooling system having a single evaporator for cooling the air in the refrigerator;

a duct system fluidly connecting the first, second and third compartments; and an air flow controller having a blower for forcing air over the evaporator and the air flow controller directing the forced air through the duct system to the first, second, and third compartments as needed to maintain their respective temperatures;

a first fan disposed in said duct, said first fan operable at a first speed for moving air into the first compartment, and, at a second speed, lower than said first speed, for preventing air flow out of the first compartment; and a second fan disposed in said duct, said second fan operable at a first speed for moving air into said second compartment and at a second speed, lower than said first speed, for preventing air flow out of said second compartment.

2. The refrigerator according to claim 1, wherein said duct system has a first inlet portion for supplying air into said first compartment and a second inlet for supplying air into said second compartment, said first fan is disposed adjacent said first inlet, and said second fan is disposed adjacent said second inlet.

3. A refrigerator comprising:

a cabinet having at least a first, a second, and a third compartment of which at least two are maintained at different temperatures;

a cooling system having a single evaporator for cooling the air in the refrigerator;

a compressor fluidly interconnected with said evaporator for moving refrigerant through said evaporator;

a latching relay for selectively connecting said compressor to a power supply;

a first switch for selectively connecting said first fan to a power supply;

a second switch for selectively connecting said second fan to a power supply; and control means for receiving user input and operating said latching relay to energize or de-energize said compressor and for firing said first and second switches such that said first and second fans can be selectively operated at said first and second speeds;

a duct system fluidly connecting the first, second, and third compartments; and an air flow controller having a blower for forcing air over the evaporator and the air flow controller directing the forced air through the duct system to the first, second, and third compartments as needed to maintain their respective temperatures.

4. A refrigerator comprising:

a cabinet having at least a first, a second, and a third compartment of which at least two are maintained at different temperatures;

a cooling system having a single evaporator for cooling the air in the refrigerator;

a duct system fluidly connecting the first, second, and third compartments; and an air flow controller having a blower for forcing air over the evaporator and the air flow controller directing the forced air through the duct system to the first, second, and third compartments as needed to maintain their respective temperatures; said air flow controller comprises a single proportional baffle to proportionally direct the cooled air from the evaporator, through the duct system, to the compartments as needed.

5. A refrigerator according to claim 4, wherein the proportional baffle comprises a movable deflector positioned in the duct system near the outflow of the forced air and between at least two of the first, second, and third compartments to proportionally deflect the forced air between the first, second, and third compartments.

6. A refrigerator according to claim 4, wherein the air flow controller includes a microprocessor control connected to a temperature sensor in at least one of the first, second, and third compartments and a motor connected to the deflector, wherein the position of the deflector relative to the outflow of forced air is adjusted by the microprocessor control in response to the at least one temperature sensor to alter the proportion of forced air between the first, second, and third compartments.

7. A refrigerator according to claim 4, wherein the duct system comprises a first portion extending between the forced air outflow and the first compartment, a second portion extending between the forced air outflow and the third compartment, and a return portion extending between the first portion and the second compartment, and wherein the deflector is positioned at the junction of the first and second portions of the duct away from the return portion.

8. A refrigerator comprising:

a cabinet having at least a first, a second, and a third compartment of which at least two are maintained at different temperatures;

a cooling system having a single evaporator for cooling the air in the refrigerator;

a duct system fluidly connecting the first, second, and third compartments; and an air flow controller having a blower for forcing air over the evaporator and the air flow controller directing the forced air through the duct system to the first second, and third compartments as needed to maintain their respective temperatures; said air flow controller comprising a proportional baffle to proportionally direct the cooled air from the evaporator, through the duct system to the compartments as needed; and said blower is positioned at the outflow of the forced air and within the duct system, and the proportional baffle comprises a movable air dam movably mounted to the blower, whereby moving the air dam proportionally splits the forced air outflow where it is directed to the first, second, and third compartments through the duct system.

9. A refrigerator according to claim 8, wherein the air dam comprises a disk having an upstanding wall extending along a portion of the circumference of the disk.

10. A refrigerator according to claim 9, wherein the duct system comprises a first portion extending between the forced air outflow and the first compartment, a second portion extending between the forced air outflow and the third compartment, and a return portion extending between the first portion and the second compartment, and wherein the air dam is positioned at the junction of the first and second portions of the duct away from the return portion.

11. A refrigerator comprising:

a cabinet having at least a first, a second, and a third compartment of which at least two are maintained at different temperatures;

a cooling system having a single evaporator for cooling the air in the refrigerator and said evaporator is operable at a plurality of different pressures;

a duct system fluidly connecting the first second, and third compartments; and an air flow controller having a blower for forcing air over the evaporator and the air flow controller directing the forced air through the duct system to the first, second, and third compartments as needed to maintain their respective temperatures.

12. The refrigerator according to claim 4 wherein said baffle further comprises:

a main damper;

means for rotating said main damper for directing said air flow to said first or third compartments;

a slide damper supported adjacent said main damper and having a cam-like engagement with said main damper such that rotation of said main damper operates to laterally move said slide damper such that said slide damper can be positioned to direct air flow to said second compartment.

13. A refrigerator, comprising:

at least three separately cooled compartments;

an evaporator chamber having an outlet;

an evaporator disposed in said evaporator chamber;

means for moving air over said evaporator and through said outlet;

a single baffle means disposed at said outlet for selectively directing independent air flow to said at least three separately cooled compartments.

* * * * *